US009836009B2

(12) United States Patent
Ishihara et al.

(10) Patent No.: US 9,836,009 B2
(45) Date of Patent: Dec. 5, 2017

(54) IMAGE FORMING APPARATUS AND IMAGE FORMING UNIT HAVING ROTATABLE STAY CONNECTING SIDE PLATES

(71) Applicant: CANON KABUSHIKI KAISHA, Tokyo (JP)

(72) Inventors: Shotaro Ishihara, Tokyo (JP); Tomoharu Kitajima, Toride (JP); Masato Yuasa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/171,524

(22) Filed: Jun. 2, 2016

(65) Prior Publication Data

US 2016/0363903 A1 Dec. 15, 2016

(30) Foreign Application Priority Data

Jun. 11, 2015 (JP) ..... 2015-118296

(51) Int. Cl.
*G03G 15/00* (2006.01)
*G03G 15/08* (2006.01)

(52) U.S. Cl.
CPC ..... *G03G 15/75* (2013.01); *G03G 15/0898* (2013.01)

(58) Field of Classification Search
CPC ..... G03G 15/75
See application file for complete search history.

(56) References Cited

U.S. PATENT DOCUMENTS 5,014,094 A * 5/1991 Amitani ..... G03G 15/0194 399/112
5,640,229 A * 6/1997 Nakahara ..... G03G 15/0896 399/119
2004/0047655 A1* 3/2004 No ..... G03G 15/105 399/238
2007/0065183 A1* 3/2007 Tomita ..... G03G 15/0877 399/258

FOREIGN PATENT DOCUMENTS

JP 2001-305928 A 11/2001
JP 2003-156934 A 5/2003
JP 3458091 B2 10/2003
JP 2006-330507 A 12/2006

* cited by examiner

*Primary Examiner* — Victor Verbitsky
(74) *Attorney, Agent, or Firm* — Fitzpatrick, Cella, Harper & Scinto

(57) ABSTRACT

An image forming apparatus includes an image forming unit having a rotatable image bearing member, a first support side plate, and a second support side plate; a development device; a transfer device; a rotatable stay; an operation portion; and a toner containing portion. The rotatable stay is disposed at a position downstream of the development device and upstream of the transfer device with respect to a rotation direction of the image bearing member to face the image bearing member and to connect the first support side plate and the second support side plate. The operation portion is provided at an end portion of the stay to rotate the stay. The toner containing portion contains the toner accumulated on the stay.

22 Claims, 9 Drawing Sheets

IMAGE FORMING APPARATUS AND IMAGE FORMING UNIT HAVING ROTATABLE STAY CONNECTING SIDE PLATES

BACKGROUND OF THE INVENTION

Field of the Invention

The present invention relates to an image forming apparatus such as an electrophotographic copying machine, an electrophotographic printer (for example, a laser beam printer, an LED printer, etc.), and a facsimile apparatus, which forms an image to a recording medium using, for example, an electrophotographic image forming system. In addition, the invention relates to an image forming unit mounted in the image forming apparatus.

Description of the Related Art

In an image forming apparatus, there is left a minute but uncontrollable toner in the vicinity of a developing nip portion where the charged toner is delivered from a developing sleeve to a photosensitive drum. The majority of the toner is conveyed by an air flow and collected and trapped by a filter portion. However, part of the toner is scattered by a viscous flow generated in accordance with the rotation of a photosensitive drum, and attached and accumulated onto members around the developing nip portion without being conveyed to the filter portion.

In this way, when the toner is accumulated on the members around the developing nip portion and the amount of the accumulated toner is increased, the toner accumulates exceeding the angle of repose of the toner and falls down and may cause contamination of an intermediate transfer belt. Then, there is a concern about that the unintended toner is transferred onto a sheet due to the contamination, thereby causing an image defect.

Therefore, there is proposed a method of preventing the intermediate transfer belt from being contaminated when the uncontrollable toner is scattered in the vicinity of the developing nip portion. For example, Japanese Patent Laid-Open No. 2003-156934 discloses a configuration in which a toner receiving tray is provided below the developing nip portion and the toner scattering and falling from the developing nip portion is received into the toner receiving tray.

Herein, a stay for securing a strength of a photosensitive unit may be provided in the configuration in which the photosensitive unit (an image forming unit) which includes the photosensitive drum and a support member to support the photosensitive drum is mounted to a main body of the apparatus so as to form an image forming portion. Then, the stay may be disposed on a downstream side in a rotation direction of the photosensitive drum and above the toner receiving tray from the developing nip portion formed between the developing sleeve and the photosensitive drum when the photosensitive unit is mounted on the main body of the apparatus.

This is because the photosensitive drum and a cleaning unit are generally unitized in the photosensitive unit. Then, the cleaning unit also serves as the stay of the photosensitive unit, and thus the strength of the cleaning unit is easily secured. On the other hand, since a diagonal region from the cleaning unit with the photosensitive drum interposed therebetween is easily decreased in strength, the stay is provided in the region to secure the strength in many cases. Then, when the photosensitive unit provided with the stay at the position is mounted on the main body of the apparatus, the stay is easily disposed on the downstream side in the rotation direction of the photosensitive drum from the developing nip portion.

In this way, in a case where the stay is disposed on the downstream side in the rotation direction of the photosensitive drum from the developing nip portion, the toner scattered from the developing nip portion due to the viscous flow generated according to the rotation of the photosensitive drum may be accumulated on the stay without being received into the toner receiving tray (see FIG. 9A). When the photosensitive drum is rotated in such a state where the scattered toner is accumulated on the stay, the toner accumulated on the stay is likely to go along the viscous flow and slide down so as to fall down onto the intermediate transfer belt without falling down into the toner receiving tray provided below the stay as illustrated in FIG. 9B. Then, in a case where the toner falls down onto the intermediate transfer belt, the unintended toner is transferred onto the sheet. Therefore, the image defect occurs.

Further, in a case where the toner is not accumulated on the stay, as illustrated in FIG. 9C, the toner scattered from the developing nip portion is not blocked by the toner receiving tray. Therefore, the intermediate transfer belt is not contaminated.

SUMMARY OF THE INVENTION

It is desirable to provide an image forming unit or an image forming apparatus which can lessen an influence of the toner accumulated on a stay provided in an image forming unit onto an image.

According to a representative configuration of the present invention, an image forming apparatus includes: an image forming unit configured to be detachably attachable to the image forming apparatus and to include a rotatable image bearing member, a first support side plate which supports one end of the image bearing member in a rotational axis direction of the image bearing member, and a second support side plate which supports the other end of the image bearing member in the rotational axis direction; a development device configured to form a toner image on the image bearing member; a transfer device configured to transfer the toner image formed by the development device onto a transfer member; a rotatable stay configured to be disposed at a position on a downstream side from the development device and on an upstream side from the transfer device in a rotation direction of the image bearing member to face the image bearing member and to connect the first support side plate and the second support side plate; an operation portion configured to be provided at an end portion of the stay to rotate the stay; and a toner containing portion configured to contain the toner accumulated on the stay.

Further features of the present invention will become apparent from the following description of exemplary embodiments with reference to the attached drawings.

DESCRIPTION OF THE EMBODIMENTS

First Embodiment

<Image Forming Apparatus>

Hereinafter, first the entire configuration of an image forming apparatus 1 according to a first embodiment of the invention will be described with reference to an operation at the time of image formation and the drawings.

Figure 1:
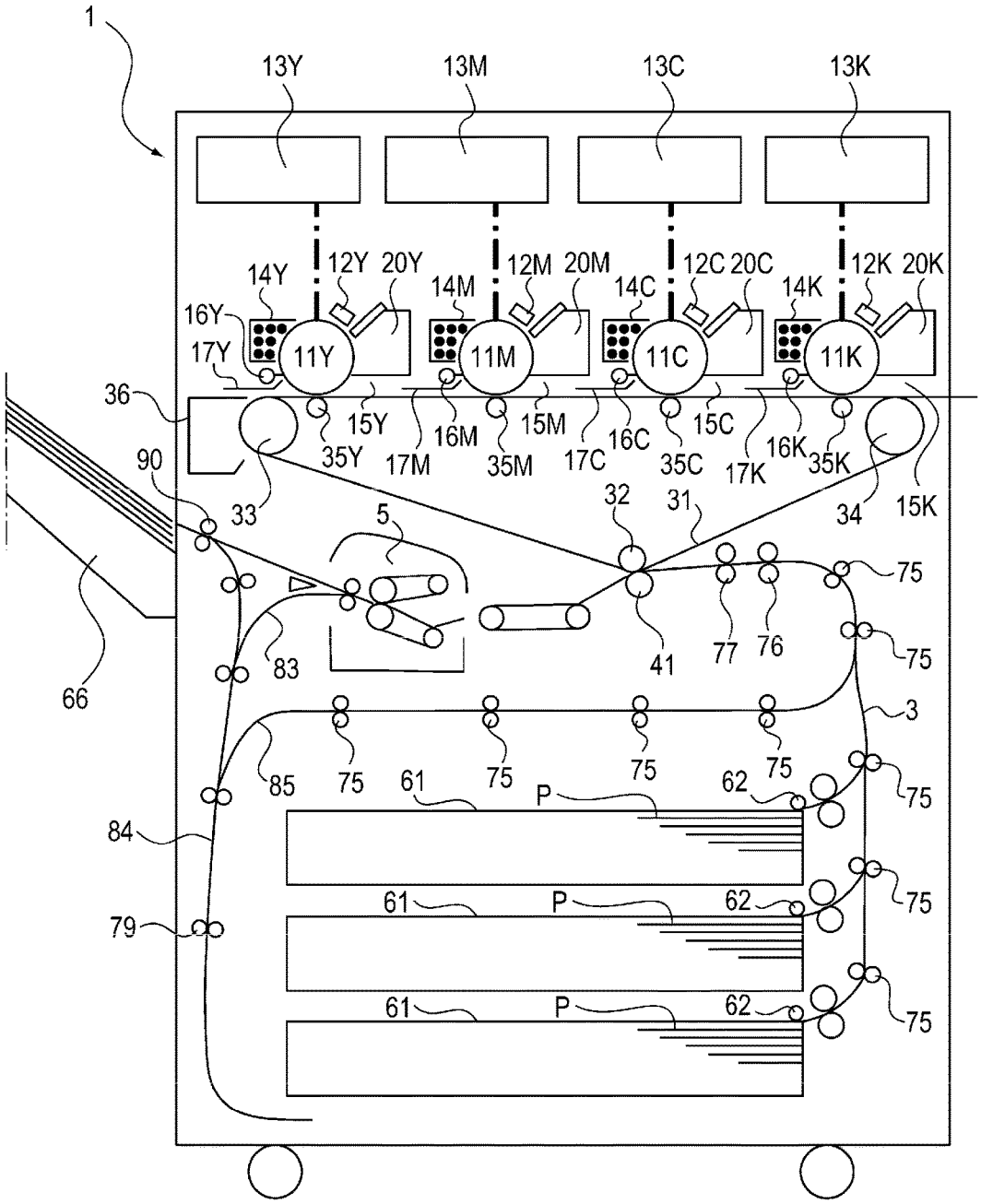
FIG. 1 is a cross-sectional view schematically illustrating an image forming apparatus according to a first embodiment.

As illustrated in FIG. 1, the image forming apparatus 1 includes an image forming portion which transfers a toner image onto a sheet P of a recording medium, a sheet feeding portion which feeds the sheet P to the image forming portion, and a fixing portion which fixes the toner image to the sheet P.

The image forming portion includes a photosensitive unit 15 (15Y, 15M, 15C, and 15K) as an image forming unit provided to be detachably attachable to the main body of the apparatus 1. In addition, a charging portion 12 (12Y, 12M, 12C, and 12K), a development device (14Y, 14M, 14C, and 14K), a laser scanner unit 13 (13Y, 13M, 13C, and 13K), and an intermediate transfer unit are provided.

The photosensitive unit 15 includes a photosensitive drum 11 (11Y, 11M, 11C, and 11K) and a cleaning unit 20 (20Y, 20M, 20C, and 20K) as a cleaning device.

The intermediate transfer unit includes a primary transfer roller 35 (35Y, 35M, 35C, and 35K), an intermediate transfer belt 31, a drive roller 33, a tension roller 34, a secondary transfer roller 32, a secondary transfer counter roller 41, and a cleaning device 36. The intermediate transfer belt 31 is an endless cylinder-shaped belt, and suspended on the drive roller 33, the tension roller 34, and the secondary transfer roller 32.

At the time of image formation, when a controller (not illustrated) issues a print signal, the sheet P stacked and stored in a sheet feeding cassette 61 is fed to a sheet conveying path by a feeding roller 62. After being separated one by one by a separation unit (not illustrated), the fed sheet P is conveyed to a pair of registration rollers 76 by a conveying roller 75 through a conveying path 3.

In the pair of registration rollers 76, a skew feeding of the sheet P is corrected by causing the leading edge of the fed sheet to abut on a conveyance guide (not illustrated). Thereafter, the sheet P is sent to a pair of conveying rollers 77, and the sheet P herein is conveyed to a secondary transfer portion at a timing of image formation (that is, a predetermined timing in synchronization with the rotation of the intermediate transfer belt 31 onto which the toner image is primarily transferred).

On the other hand, first the surface of the photosensitive drum 11 is charged by the charging portion 12 in the image forming portion. Then, the laser scanner unit 13 emits a laser light from a light source (not illustrated) provided therein, and irradiates the photosensitive drum 11 with the laser light. Therefore, an electrostatic latent image is formed on the surface of the photosensitive drum 11. The toner image is formed on the photosensitive drum 11 by developing the electrostatic latent image by the development device 14.

The toner image formed on the photosensitive drum 11 is primarily transferred onto the intermediate transfer belt 31 by applying a transfer bias to the primary transfer roller 35. When the drive roller 33 receives a rotational force from a drive source such as a motor (not illustrated), the intermediate transfer belt 31 starts to be rotated. The primarily transferred toner image reaches the secondary transfer portion which is formed by the secondary transfer roller 32 and the secondary transfer counter roller 41 on the downstream side in a rotation direction by the rotation of the intermediate transfer belt 31. Herein, the toner image is transferred onto the sheet P.

The sheet P with the toner image transferred thereon is sent to a fixing device 5 where the toner image is fixed onto the sheet P with heating and pressuring. Thereafter, the sheet P is conveyed by a discharge roller 90 and discharged to a discharge portion 66.

Further, in a case where both surfaces of the sheet P are subjected to the image formation, first the sheet P passes through the fixing device 5 and then is conveyed to a reversing path 83, and drawn back from the reversing path 83 to a switchback path 84. Then, the leading end and the tailing end of the sheet are switched by changing a rotation direction of a pair of reverse rollers 79 forwardly or reversely, and the sheet is conveyed to a duplex conveying path 85. Thereafter, the sheet P is conveyed by the conveying roller 75, and conveyed to the secondary transfer portion again through the pair of registration rollers 76. The subsequent image forming processes are similar to the above description.

<Photosensitive Unit>

Figure 2:
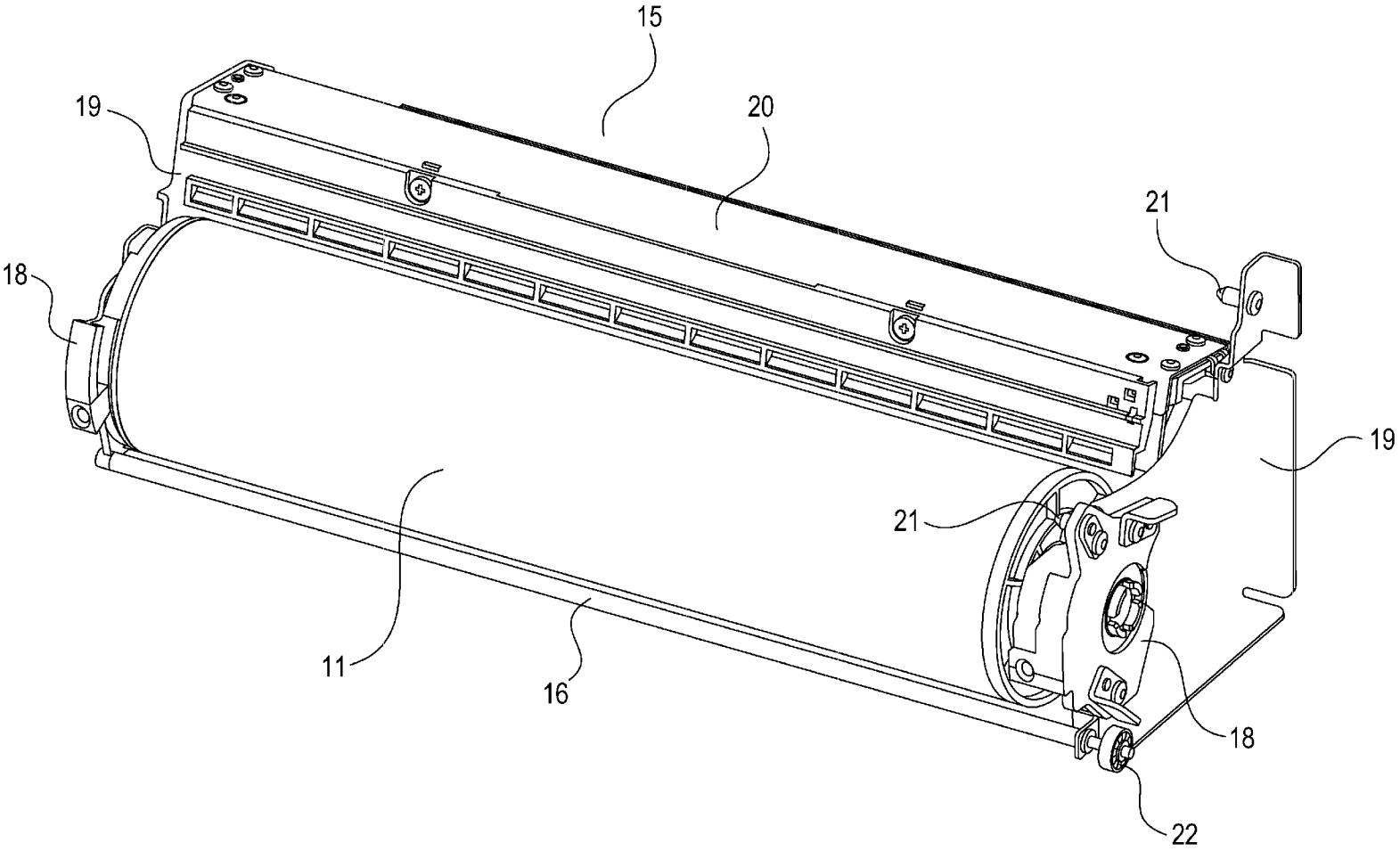
FIG. 2 is a perspective view illustrating a photosensitive unit according to the first embodiment.

Next, a configuration of the photosensitive unit 15 according to this embodiment will be described in detail. As illustrated in FIG. 2, the photosensitive unit 15 includes a front and rear side plate 19 as a support member. A casing 18 is screwed to the front and rear side plate 19. The casing 18 includes a bearing, and a rotating shaft of the photosensitive drum 11 is fitted to the bearing such that the photosensitive drum 11 is rotatably supported thereto.

In addition, the cleaning unit 20 is supported to the front and rear side plate 19. The cleaning unit includes a cleaning blade (not illustrated) and a fur brush (not illustrated), and collects the residual toner attached to the photosensitive drum 11. Further, the collected residual toner is conveyed backward to the main body by a screw, and conveyed to a collect toner box which is exchangeable.

In addition, a stay 16 of a cylindrical shaft shape is supported to the casing 18 in order to prevent that the front and rear side plate 19 is opened and to secure a strength of the photosensitive unit 15 and the front and rear side plate 19. The stay 16 is disposed diagonally to the cleaning unit 20 with the photosensitive drum 11 interposed in the center. In other words, the stay 16 is at a position on a side opposed to the cleaning unit 20 with respect to the center axis of the photosensitive drum 11. Since the cleaning unit 20 serves as the stay, the stay 16 is provided at the above-described position in order to secure more strength of the photosensitive unit 15 and the front and rear side plate 19. Further, the photosensitive unit 15 can be realized in a small space by providing the stay 16 near the photosensitive drum 11.

Figure 3:
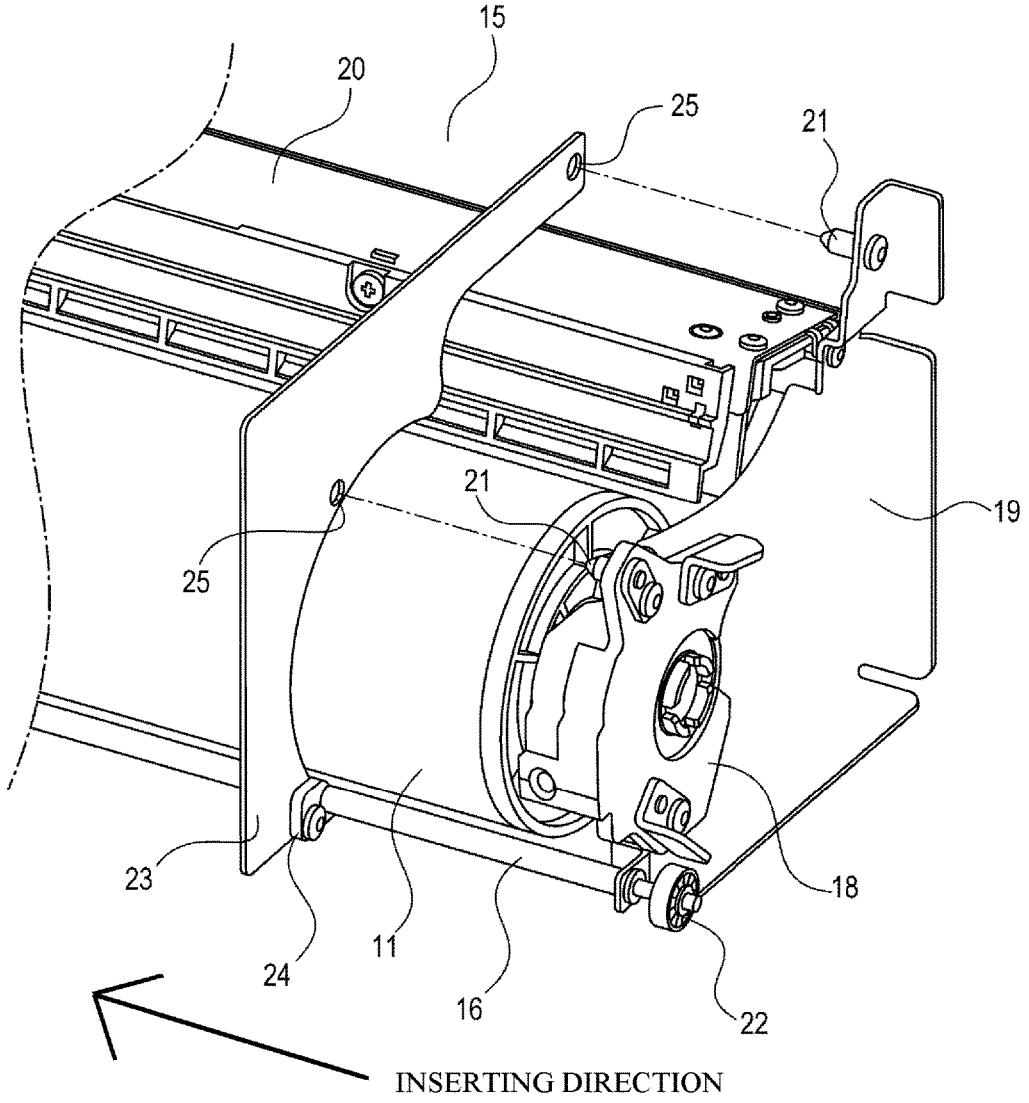
FIG. 3 is a perspective view illustrating the photosensitive unit according to the first embodiment.

FIG. 3 is a diagram illustrating the photosensitive unit 15 in the middle of being inserted into a side plate 23 of the main body of the image forming apparatus 1. When the photosensitive unit 15 is mounted in the main body, as illustrated in FIG. 3, first the posture of the stay 16 is maintained by being inserted into the main body while being fitted to a fitting member 24 fixed to the side plate 23. In this embodiment as described above, the stay 16 also serves as a guide unit which guides the position of the apparatus when the photosensitive unit 15 is mounted in the main body.

Next, after the insertion of the stay 16, a fitting piece 21 of the casing 18 is fitted into a fitting hole 25 of the side plate 23, so that the photosensitive unit 15 is positioned.

Figure 4A:
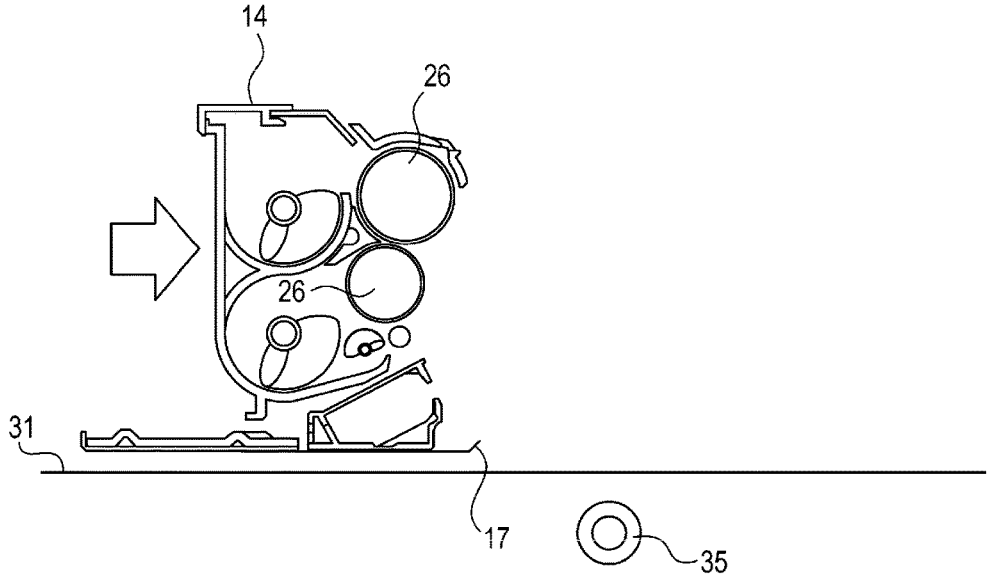
FIGS. 4A and 4B are cross-sectional views schematically illustrating a configuration before and after the photosensitive unit according to the first embodiment is mounted.
Figure 4B:
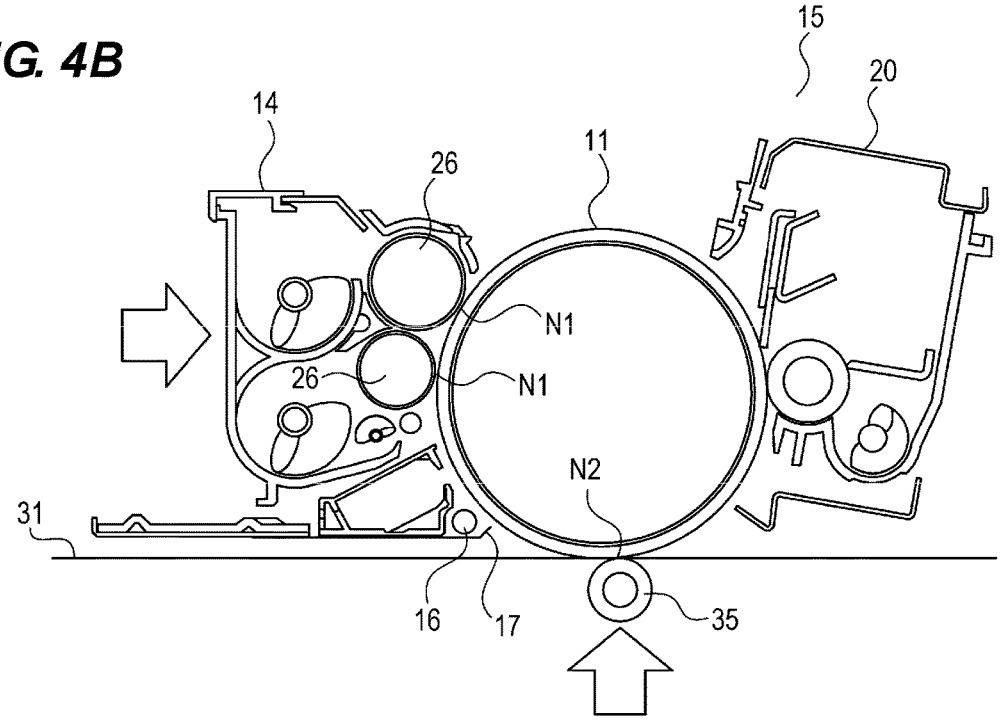

FIG. 4A illustrates a peripheral configuration of the image forming portion before the photosensitive unit 15 is mounted, and FIG. 4B illustrates a peripheral configuration of the image forming portion after the photosensitive unit 15 is mounted.

As illustrated in FIG. 4A, there are a developing sleeve 26 as a toner bearing member of the development device 14 and the primary transfer roller 35 as a transfer member in the vicinity of the portion where the photosensitive unit 15 is mounted. In addition, a toner receiving tray 17 (a toner receiving member) is provided near the intermediate transfer belt 31 below the developing sleeve 26. The toner receiving tray 17 is used to catch the toner in order to prevent that the uncontrollable toner scattering from a developing nip portion N1 formed between the photosensitive drum 11 and the developing sleeve 26 falls down onto the intermediate transfer belt 31. Further, the toner receiving tray 17 is made of an elastically deformable member such as a polyethylene terephthalate sheet or a thin stainless steel plate, so that it is possible to prevent that the stay 16 used as a guide unit is hindered from being inserted or removed at the time when the photosensitive unit 15 is attached or detached.

As illustrated in FIG. 4B, when the photosensitive unit 15 is mounted, first the development device 14 is pressed up to a predetermined position in a direction toward the photosensitive drum 11, and a distance between the photosensitive drum 11 and the developing sleeve 26 is secured. Therefore, the developing nip portion N1 is formed between the developing sleeve 26 and the photosensitive drum 11, and the toner is delivered in the developing nip portion N1 at the time of image formation.

In addition, the primary transfer roller 35 is pressed with respect to the photosensitive drum 11, and a primary transfer nip portion N2 is formed between the primary transfer roller 35 and the photosensitive drum 11. In the primary transfer nip portion N2, the toner image formed in the surface of the photosensitive drum 11 at the time of image formation is transferred onto the intermediate transfer belt 31.

Herein, when the photosensitive unit 15 is mounted in the main body of the image forming apparatus 1 according to this embodiment, the stay 16 is disposed on the downstream side in a rotation direction of the photosensitive drum 11 from the developing nip portion N1 and on the upstream side in the rotation direction from the primary transfer nip portion N2 as illustrated in FIG. 4B. In addition, the toner receiving tray 17 is disposed below the stay 16. For this reason, the toner scattering from the developing nip portion N1 does not directly fall into the toner receiving tray 17 due to a viscous flow generated in accordance with the rotation of the photosensitive drum 11 but falling onto the stay 16. Therefore, there is a concern that the toner accumulates on the stay 16.

Figure 5A:
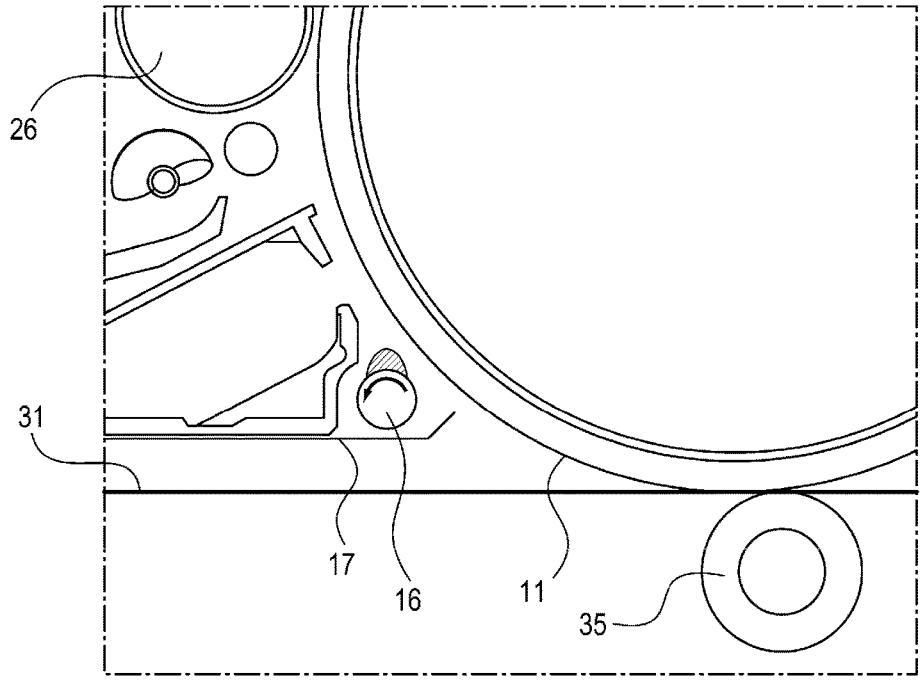
FIGS. 5A and 5B are diagrams for describing a stay operation according to the first embodiment.
Figure 5B:
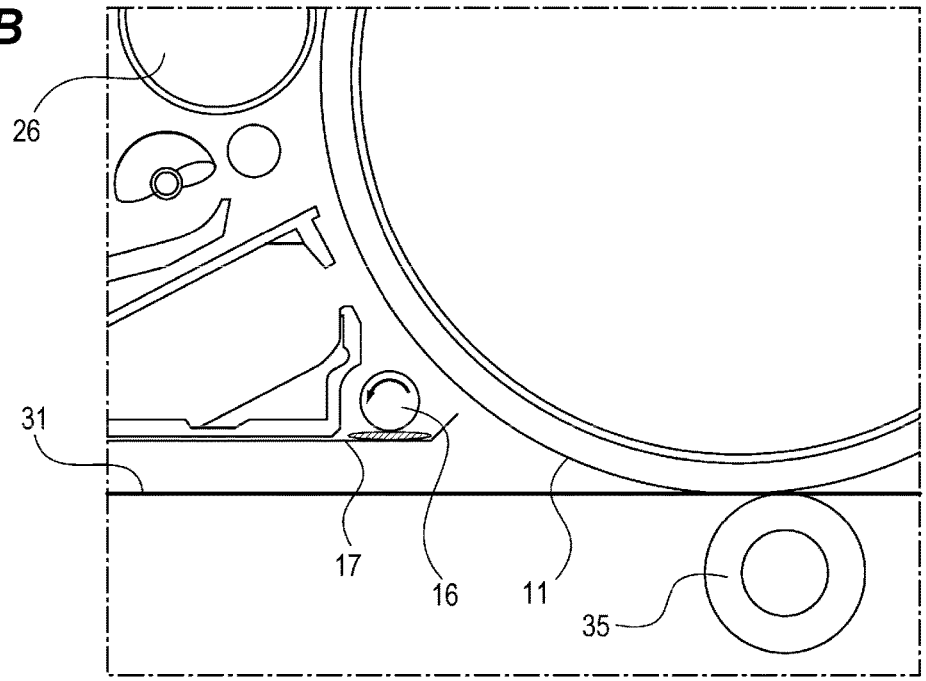

In this embodiment, the stay 16 is rotatably provided in order to prevent that the toner is accumulated on the stay 16. Therefore, when the toner is accumulated on the stay 16 (see FIG. 5A), the stay 16 is rotated as illustrated in FIG. 5B so that the toner can be made to fall into the toner receiving tray 17 by the weight of the toner. Therefore, it is possible to prevent that the toner accumulated on the stay 16 is scattered by the viscous flow, and to prevent that the toner falls down to the intermediate transfer belt 31. Accordingly, it is possible to prevent an image defect from occurring.

In addition, as described in this embodiment, since the stay 16 is a member of the cylindrical shaft shape, the stay 16 is easily rotated, and the toner is hardly accumulated on the stay 16. In addition, the same effect can be achieved regardless of whether the stay 16 is rotated in the clockwise direction or in the counterclockwise direction.

Figure 7:
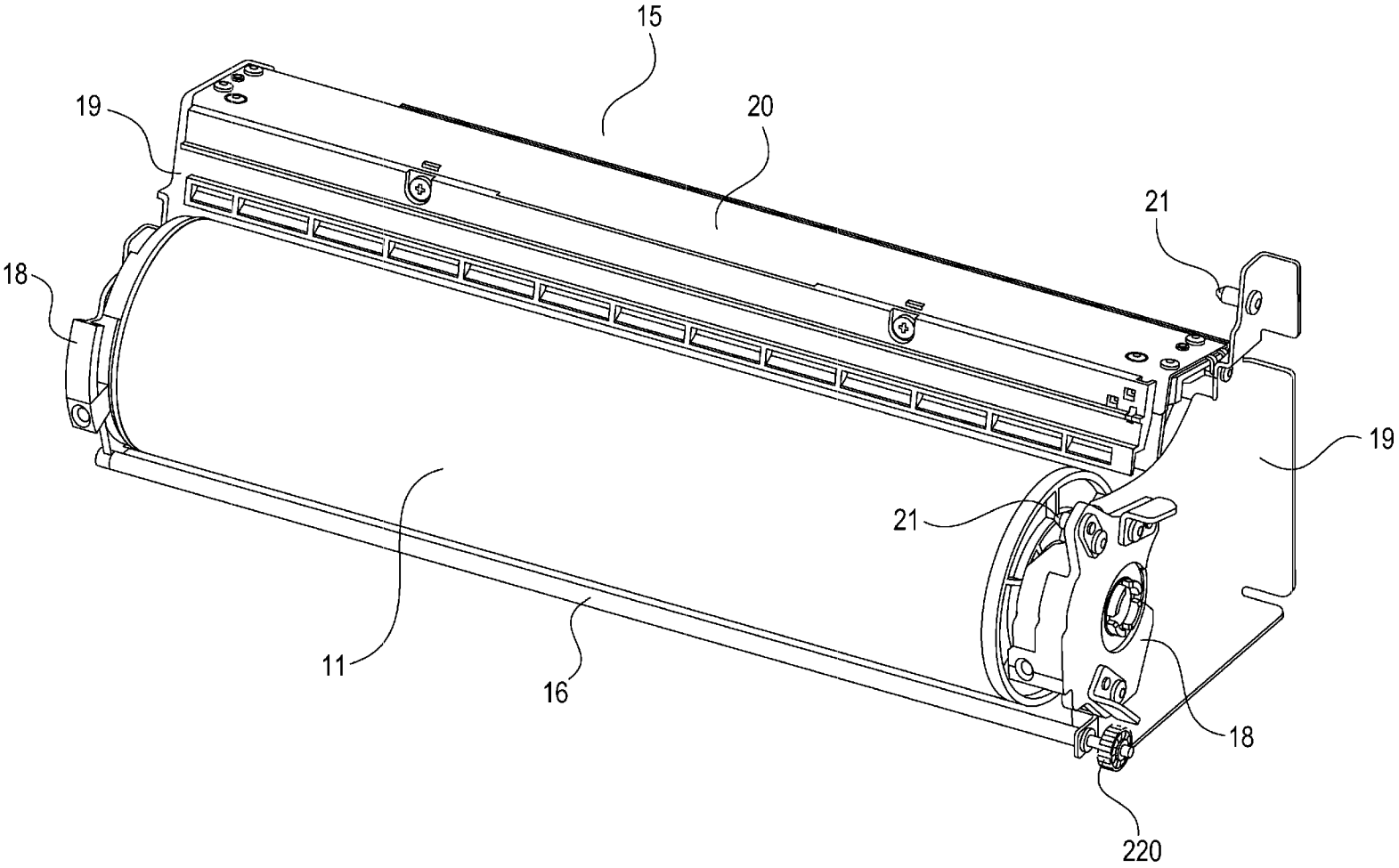
FIG. 7 is a perspective view of a photosensitive unit according to another configuration.
Figure 8:
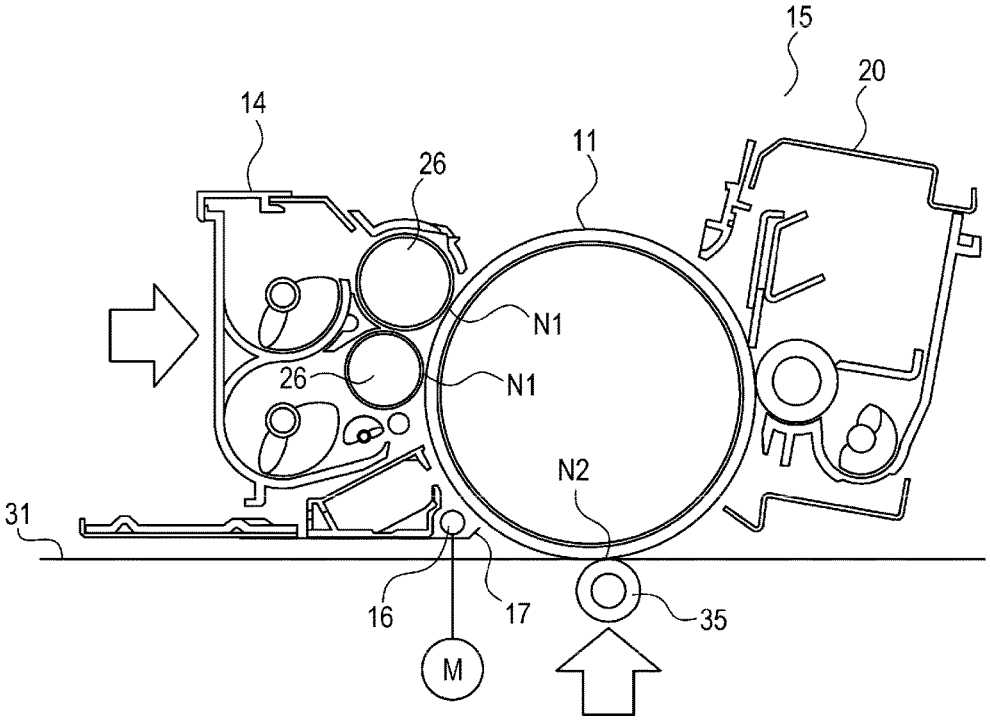
FIG. 8 is a cross-sectional view schematically illustrating a configuration in a state where the photosensitive unit according to another configuration is mounted.
Figure 9A:
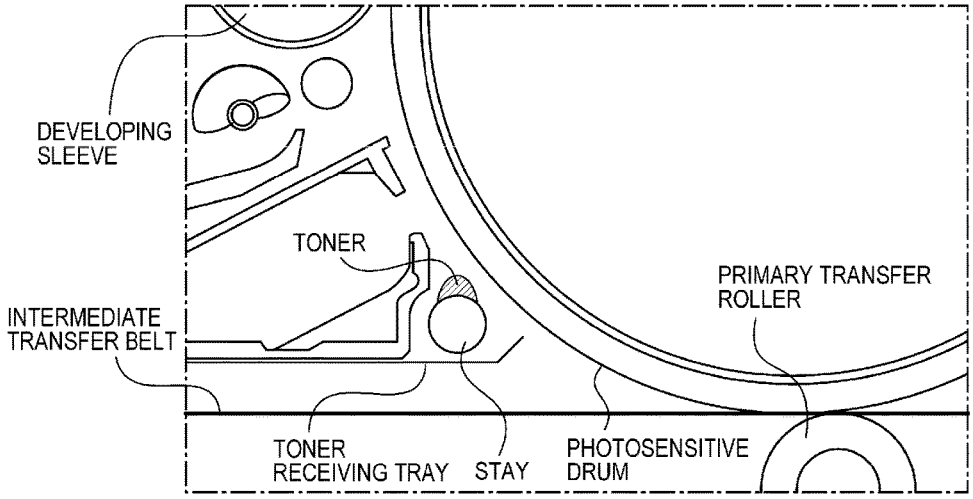
FIGS. 9A to 9C are diagrams for describing a problem in the related art.
Figure 9B:
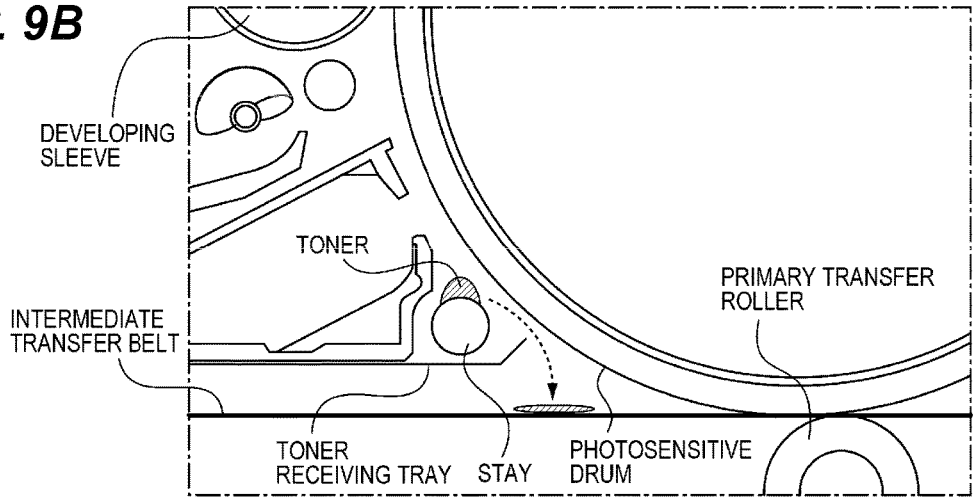
Figure 9C:
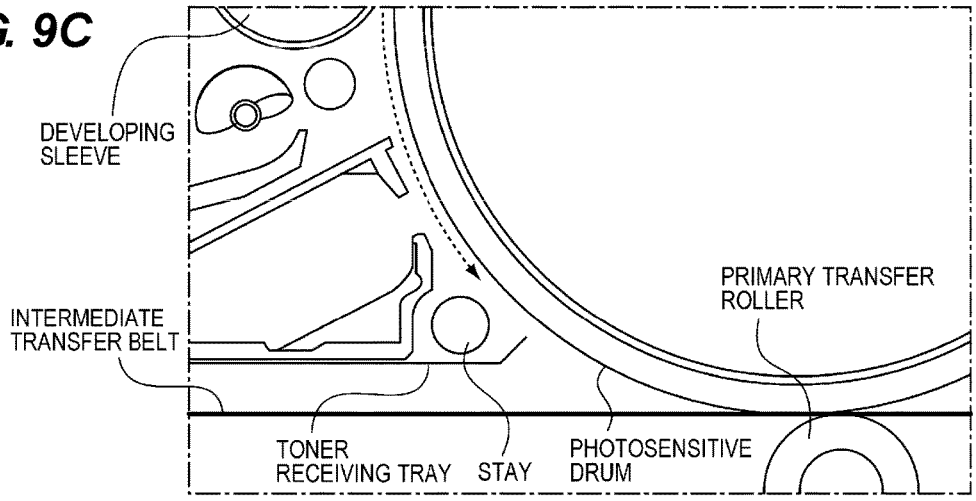

Further, as a method of rotating the stay 16, the stay 16 may be configured to be manually rotated by a serviceman or a user. Alternatively, a driving force may be transmitted from a drive source such as a motor to rotate the stay 16. In a case where the stay is manually rotated, a holding portion or handling member 22 illustrated in FIG. 2 can be provided at the end portion of the stay 16 as described in this embodiment. Therefore, since the serviceman or the user can hold the holding portion 22 to rotate the stay 16, the stay 16 can be easily rotated. On the other hand, as a configuration of the rotation using a motor, there can be exemplified a drum unit configuration in which a gear 220, which is a driving force transmission member to transmit the driving force from the drive source (motor) M illustrated in FIG. 8 to the stay, is disposed at the end portion of the stay 16 as illustrated in FIG. 7.

Figure 6A:
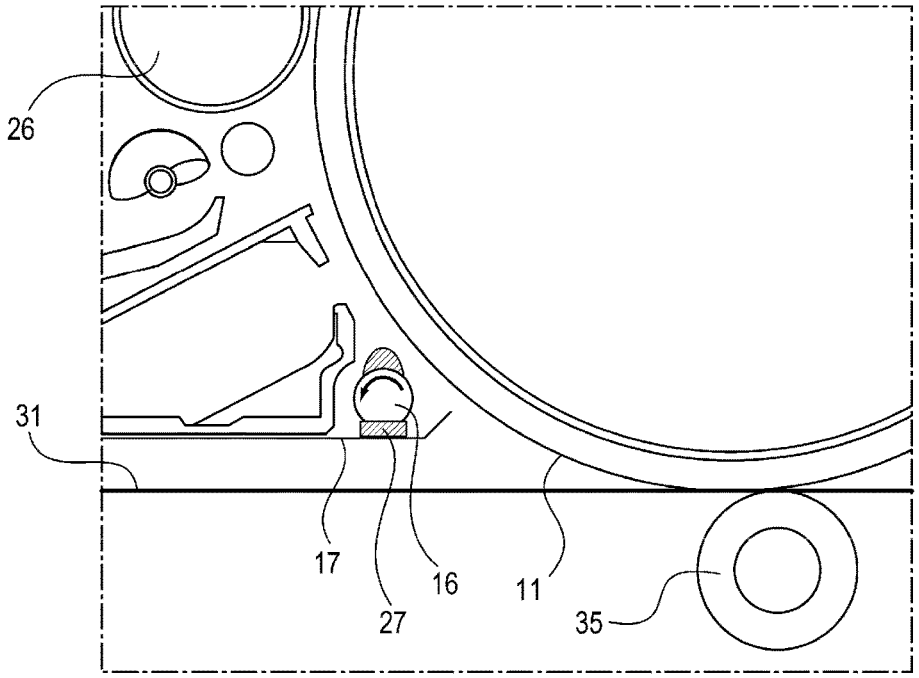
FIGS. 6A and 6B are diagrams for describing an operation of the stay and a stay cleaning member according to the first embodiment.
Figure 6B:
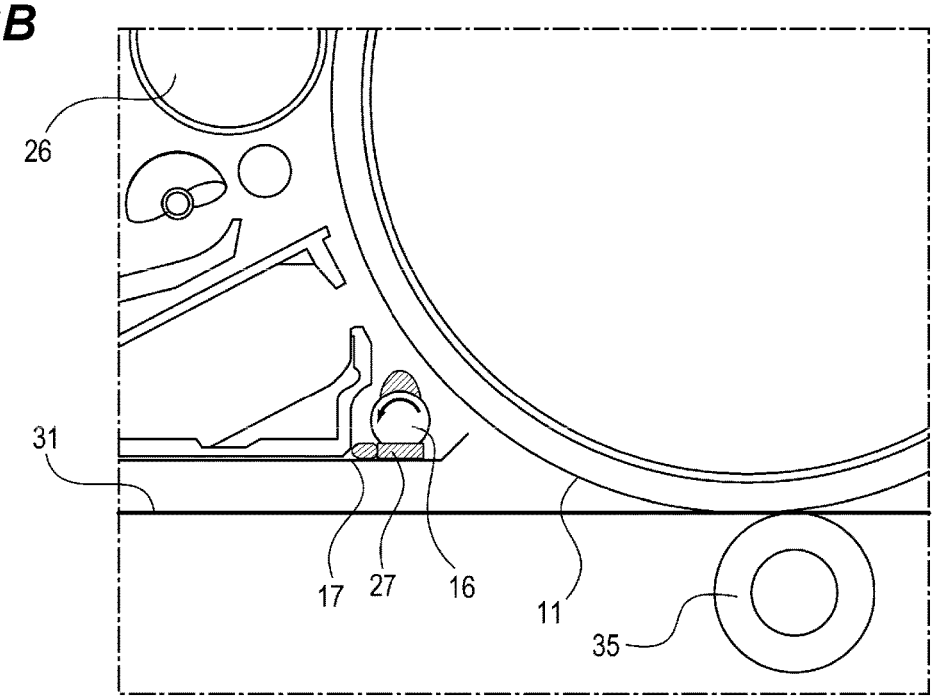

In addition, as illustrated in FIG. 6A, a stay cleaning member 27 for removing the toner accumulated on the stay 16 may be configured to be provided to abut on the stay 16. With this configuration, the stay cleaning member 27 can sweep off the toner on the stay 16, so that the cleaning performance can be improved. The toner swept off by the stay cleaning member 27 is held in the toner receiving tray 17 as illustrated in FIG. 6B.

Further, the stay cleaning member 27 can be provided between the stay 16 and the toner receiving tray 17. Therefore, the toner swept off by the stay cleaning member 27 is easily held in the toner receiving tray 17.

In addition, a capillaceous member such as a fur brush, a fiber-implanted member, and a felt material can be used as a material of the stay cleaning member 27. Alternatively, there may be used an elastic member such as a spongy material having roughness in its surface. Therefore, abrasion of the stay 16 can be reduced while improving the cleaning performance.

In addition, this embodiment has been described about an example of a color image forming apparatus of an intermediate transfer system, but the invention is not limited thereto. The invention may be applied to a monochrome image forming apparatus in which the toner image formed in the photosensitive drum is directly transferred on to the sheet. In other words, at the time when the photosensitive unit is mounted in the main body of the apparatus, the stay may be configured to be rotatably provided on the downstream side in the rotation direction of the photosensitive drum from the developing nip portion and on the upstream side from the transfer nip portion formed between the photosensitive drum and the transfer roller. With this configuration, it is possible to prevent that the toner is accumulated on the stay. It is possible to prevent that the toner on the stay falls down to the sheet causing an image defect.

In addition, the invention can be applied even to a process cartridge which is detachably attachable to the main body of the image forming apparatus. In other words, the apparatus may be configured to include the development device, the photosensitive unit which includes the photosensitive drum (the photosensitive unit which is detachably attachable to the main body of the process cartridge) and a support member for supporting the photosensitive drum, and the stay which secures the strength of the support member and is rotatably provided. With this configuration, it is possible to prevent that the toner is accumulated on the stay by rotating the stay when the process cartridge is mounted in the main body of the apparatus and the stay is disposed on the downstream side in the rotation direction of the photosensitive drum from the developing nip portion, and on the upstream side from the transfer nip portion, and above the toner receiving tray. Therefore, it is possible to prevent that the toner on the stay falls down to the intermediate transfer belt and the sheet causing an image defect.

According to the invention, since the stay is rotatably provided, the toner on the stay falls down to the toner receiving member according to the rotation of the stay. Therefore, since the toner is hardly accumulated on the stay, it is possible to prevent that the toner accumulated on the stay is scattered by the viscous flow and falls down to the intermediate transfer belt causing an image defect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-118296, filed Jun. 11, 2015, which is hereby incorporated by reference herein in its entirety.

What is claimed is:

1. An image forming apparatus comprising:

an image forming unit configured to be detachably attachable to the image forming apparatus and to include i) a rotatable image bearing member, ii) a first support side plate which supports one end of the image bearing member with respect to a rotational axis direction of the image bearing member, and iii) a second support side plate which supports another end of the image bearing member with respect to the rotational axis direction;

a developing roller configured to form a toner image on the image bearing member at a developing position where the developing roller faces the image bearing member;

a developing container having the developing roller;

a transfer portion configured to transfer the toner image formed by the developing roller onto a transfer member at a transfer position where the transfer member faces the image bearing member;

a rotatable stay disposed to face the image bearing member at a position downstream of the developing position and upstream of the transfer position with respect to a rotation direction of the image bearing member to connect the first support side plate and the second support side plate;

a handling member, provided at an end portion of the rotatable stay at an upstream side with respect to an inserting direction of the image forming unit into the image forming apparatus, configured to rotate the rotatable stay, the handling member disposed at an upstream side of the first support side plate and the second support side plate with respect to the inserting direction; and a toner containing portion, disposed below the rotatable stay in the vertical direction, configured to contain the toner accumulated on the rotatable stay, wherein the rotatable stay includes a stay guiding portion provided between the first and second support side plates and guides the image forming unit in the rotational axis direction of the image bearing member when the image forming unit is inserted into a main body of the image forming apparatus.

2. The image forming apparatus according to claim 1, wherein the stay is of a cylindrical shaft shape.

3. The image forming apparatus according to claim 1, further comprising:

a cleaning member configured to be provided between the stay and the toner containing portion and to abut on the stay to clean the stay by removing the toner attached to the stay.

4. The image forming apparatus according to claim 3, wherein the cleaning member is a capillaceous member.

5. The image forming apparatus according to claim 1, wherein the toner containing portion is an elastically deformable member.

6. An image forming apparatus comprising:

an image forming unit configured to be detachably attachable to the image forming apparatus and to include i) a rotatable image bearing member, ii) a first support side plate which supports one end of the image bearing member with respect to a rotational axis direction of the image bearing member, and iii) a second support side plate which supports another end of the image bearing member with respect to the rotational axis direction;

a developing roller configured to form a toner image on the image bearing member at a developing position where the developing roller faces the image bearing member;

a developer container housing the developing roller;

a transfer portion configured to transfer the toner image formed by the developer roller onto a transfer member at a transfer position where the transfer member faces the image bearing member;

a rotatable stay disposed at a position downstream of the developing position and upstream of the transfer position with respect to a rotation direction of the image bearing member to connect the first support side plate and the second support side plate;

a driving force transmission member configured to be provided at an end portion of the rotatable stay to transfer a driving force to rotate the rotatable stay; and a toner containing portion, disposed below the rotatable stay in the vertical direction, configured to contain the toner accumulated on the rotatable stay, wherein the rotatable stay includes a stay guiding portion provided between the first and second support side plates and guides the image forming unit in the rotational axis direction of the image bearing member when the image forming unit is inserted into a main body of the image forming apparatus.

7. The image forming apparatus according to claim 6, wherein the stay is of a cylindrical shaft shape.

8. The image forming apparatus according to claim 6, further comprising:

a cleaning member configured to be provided between the stay and the toner containing portion and to abut on the stay to clean the stay by removing the toner attached to the stay.

9. The image forming apparatus according to claim 8, wherein the cleaning member is a capillaceous member.

10. The image forming apparatus according to claim 6, wherein the toner containing portion is an elastically deformable member.

11. An image forming unit comprising:

a rotatable image bearing member;

a first support side plate which supports one end of the image bearing member with respect to a rotational axis direction of the image bearing member;

a second support side plate which supports another end of the image bearing member with respect to the rotational axis direction;

a rotatable stay disposed to face the image bearing member at a position lower than that of a rotational center of the image bearing member with respect to a vertical direction to connect the first support side plate and the second support side plate;

a handling member provided at an end of the rotatable stay at a side of the one end of the image bearing member and configured to rotate the rotatable stay; and a toner containing portion, disposed below the rotatable stay in a vertical direction, configured to contain toner accumulated on the rotatable stay, wherein the handling member is disposed outside of the first support side plate with respect to the rotational axis direction of the image bearing member, and wherein the rotatable stay includes a stay guiding portion provided between the first and second support side plates and guides the image forming unit in the rotational axis direction of the image bearing member when the image forming unit is inserted into a main body of an image forming apparatus.

12. The image forming unit according to claim 11, wherein the stay is of a cylindrical shaft shape.

13. The image forming unit according to claim 11, further comprising:

a cleaning member configured to abut on the stay to clean the stay by removing the toner attached to the stay.

14. The image forming unit according to claim 13, wherein the cleaning member is a capillaceous member.

15. The image forming unit according to claim 11, wherein the image forming unit includes a removing member configured to remove the toner on the image bearing member.

16. The image forming unit according to claim 15, wherein the stay is on a side opposed to the removing member with respect to the rotational center axis of the image bearing member.

17. An image forming unit comprising:

a rotatable image bearing member;

a first support side plate which supports one end of the image bearing member with respect to a rotational axis direction of the image bearing member;

a second support side plate which supports another end of the image bearing member with respect to the rotational axis direction;

a rotatable stay disposed to face the image bearing member at a position lower than that of a rotational center of the image bearing member with respect to a vertical direction to connect the first support side plate and the second support side plate;

a driving force transmission member configured to be provided at an end portion of the rotatable stay to transfer a driving force to rotate the rotatable stay; and a toner containing portion, disposed below the rotatable stay in a vertical direction, configured to contain toner accumulated on the rotatable stay, wherein the rotatable stay includes a stay guiding portion provided between the first and second support side plates and guides the image forming unit in the rotational axis direction of the image bearing member when the image forming unit is inserted into a main body of an image forming apparatus.

18. The image forming unit according to claim 17, wherein the stay is of a cylindrical shaft shape.

19. The image forming unit according to claim 17, further comprising:

a cleaning member configured to abut on the stay to clean the stay by removing the toner attached to the stay.

20. The image forming unit according to claim 19, wherein the cleaning member is a capillaceous member.

21. The image forming unit according to claim 17, wherein the image forming unit includes a removing member configured to remove the toner on the image bearing member.

22. The image forming unit according to claim 21, wherein the stay is on a side opposed to the removing member with respect to the rotational center axis of the image bearing member.

* * * * *